United States Patent [19]

Rath

[11] Patent Number: 4,735,002

[45] Date of Patent: Apr. 5, 1988

[54] SURFACE MOUNTED TURBINE-DRIVEN HAIR DRYER

[76] Inventor: Robert J. Rath, 606 Calle Embocadura, San Clemente, Calif. 92672

[21] Appl. No.: 923,604

[22] Filed: Oct. 27, 1986

[51] Int. Cl.[4] ..... F26B 21/00; A45D 20/08

[52] U.S. Cl. ..... 34/97; 219/369; 219/370

[58] Field of Search ..... 34/96, 97; 415/537; 219/369, 370

[56] References Cited

U.S. PATENT DOCUMENTS

| | | | |
|---|---|---|---|
| 3,095,496 | 6/1963 | Omohundro | 219/369 |
| 3,257,528 | 6/1966 | Mertler | 219/370 |
| 3,280,302 | 10/1966 | Jepson | 219/370 |
| 3,844,674 | 10/1974 | Moriyama | 415/53 T |
| 4,483,656 | 11/1984 | Abe et al. | 415/53 T |
| 4,493,975 | 1/1985 | Yamamoto | 219/370 |

*Primary Examiner*—Albert J. Makay
*Assistant Examiner*—David W. Westphal
*Attorney, Agent, or Firm*—Brown, Martin, Haller & Meador

[57] ABSTRACT

A surface-mounted hair dryer is described which contains a turbine as the motive power for the air flow, incorporates means for minimizing drawing moisture into the unit when it is being used in a humid environment, provides for automatic and positive means of turning the unit on and off and can optionally provide alternate modes of operation including heating of the air to greater or lesser degrees, use of the air blowing feature without the heating or variable speeds of the turbine and resultant differences in air flow rate.

7 Claims, 3 Drawing Sheets

SURFACE MOUNTED TURBINE-DRIVEN HAIR DRYER

FIELD OF THE INVENTION

The invention herein relates to surface-mounted hair dryers, particularly to wall mounted hair dryers.

BACKGROUND OF THE INVENTION

In recent years surface-mounted (particularly wall-mounted) hair dryers have become a popular feature in hotels. Many of the better hotels in the United States, Europe and elsewhere have installed the wall-mounted hair dryers in their guest bathrooms for the convenience of the hotel guests. These hotels have found that guests appreciate the convenience of having hair dryers available, so that the guests do not need to carry portable hair dryers in their luggage. The wall-mounted hair dryers have thus become a significant element in travelers' decisions regarding choice of hotel accommodations.

The use and presence of a permanent hair dryer in a hotel bathroom have not been without problems, however. Since a great deal of moisture and humidity is generated when a guest showers, bathes or shaves in a hotel bathroom, the hair dryer is subjected to operation under extremely humid conditions. In particular, it has been common for excessive moisture to be drawn into the air intake of the hair dryer and its operation thereby adversely affected.

Movement of air through these types of units and force of the air exhaust for hair drying has often been inadequate. The prior hair dryer units have used simple fan blades or "squirrel cage" rotors to draw in air and exhaust the air for drying. These devices, however, are frequently incapable of moving adequate quantities of air unless the devices are expanded to an unwieldy or uneconomical size.

Yet another problem has arisen with the method of turning the units on and off. Conventionally this has been accomplished by incorporating a recess into the hair dryer housing and placing a normally closed off/on switch in the top of the recess. The hand-held nozzle of the hair dryer, which is connected to the air outlet of the dryer by a flexible conduit, is seated in the recess when the unit is not in use. When the nozzle is properly seated in the recess it will contact the normally closed switch and depress the switch to an open position, thus cutting power to the hair dryer motor and turning the unit off. When the nozzle is removed from the recess by the user, the switch returns to its normally closed position and the motor and heating element are started. It has frequently been found, however, that users replace the nozzle in the recess in a misaligned position, such that the nozzle does not fully open the switch and the hair dryer fails to shut off after use. Either or both the heating element and motor may then be burnt out.

Finally, it is not uncommon for the flexible conduit connecting the hair dryer outlet and the nozzle to become detached from the outlet, so that the air blows along the wall surface and cannot be used by the hotel guest for hair drying.

It would therefore be advantageous to have a surface-mounted (particularly wall-mounted) hair dryer which would provide significant quantities of air at a high flow rate and which could be easily and positively turned on and off by use of the hair dryer nozzle. Such a unit would also incorporate means for minimizing the effects of the ambient moisture and also minimizing or eliminating the tendency for the flexible conduit to separate from the main hair dryer unit.

BRIEF SUMMARY OF THE INVENTION

In its broadest form the invention comprises an improvement in a surface-mounted hair dryer. The basic hair dryer has as its components a housing having one side adapted to mount on the surface and having an air inlet and an air outlet thereto, the inlet and outlet being the opposite ends of an air flow path defined through said housing; an air impeller in said flow path to cause air to flow along the air path from the inlet to the outlet; heat generating means in the flow path to warm the air; a flexible conduit connecting the air outlet of the housing to a remote air exit nozzle and through which the warmed air passes to be directed toward the user's hair; and means to activate the impeller. The present improvement on the basic hair dryer invention comprises the air inlet being located in said housing adjacent the side which is adapted to mount on the surface and being disposed proximate the lower end of the housing when the housing is mounted on the surface in a vertical orientation; an air chamber within the housing and in the flow path between the housing air inlet and the impeller, the chamber itself having an air inlet and an air outlet; and the impeller comprising a rotary air turbine having a plurality of radially extending blades, the turbine blades being disposed closely adjacent to the air chamber outlet and, upon activation of the turbine, creating a zone of reduced air pressure at the air chamber outlet, and drawing air from the air chamber and forcing it under pressure toward the housing air outlet, conduit and exit nozzle.

In various embodiments of the invention, the improvement also comprises having an off/on switch centrally disposed in the nozzle housing with the nozzle thus making positive on/off contact with the switch. In another preferred embodiment the flexible conduit is secured by a screw fit to the air outlet of the main hair dryer component. The device is also configured such that the air drawn in by the turbine passes over the motor, cooling the motor and thus substantially reducing its operating noise and prolonging its life.

DETAILED DESCRIPTION AND PREFERRED EMBODIMENTS

Figure 1:
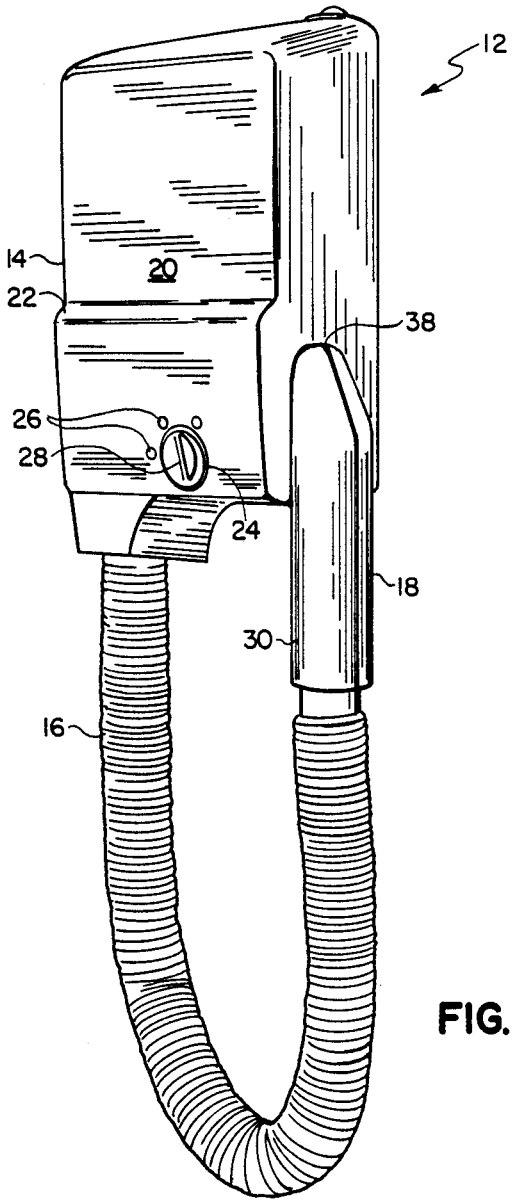
FIG. 1 is a perspective view of an enclosed unit as it appears in a typical wall-mounted configuration with the exit nozzle being seated in its recess on the hair dryer housing and the unit being turned off.

The invention herein will be most readily understood by reference to the drawings. FIG. 1 illustrates the outward appearance of the unit 12 in its normal wall-mounted configuration. Externally the unit 12 is divided into three sections; the main component 14 housing the blower or impeller and all electrical circuitry for operating the unit, the flexible conduit (or "hose") 16 connecting the outlet of the blower to the drying nozzle 18, and nozzle 18 itself, which is gripped in the hand of the user and by which the user directs the air flow to the various portions of his or her hair. As illustrated in FIG. 1 the main unit 14 is housed in a generally squarish or rectangular housing 20. Typically the housing is about 10 inches high, 8 inches wide and 3 inches deep (25 cm high, 20 cm wide and 8 cm deep). The housing may be made of any sturdy material which will provide the desired strength and appearance and which is safe for use in humid bathrooms. Preferred are plastics such as the styrenes, phenolics and the like. The particular material used, however, is not critical to this invention, and the types of materials used for prior art wall-mounted hair dryers are quite suitable for the present unit.

If desired the front surface of the housing 20 can have applied to it a decorative pattern, wording identifying the manufacturer or vendor of the unit or such other visual items as the designer may choose. In FIG. 1 such an ornamental design is indicated by the offset 22 molded into the surface 20. Alternatively one could mold into the surface 20 diagonal ribs or another decorative pattern. Similarly the side surfaces of the unit may be decorated if desired. In yet another alternative the front and/or sides of the unit may be left undecorated but with a smooth surface to which subsequent designs, logos, finishes or the like may be applied.

FIG. 1 also illustrates the incorporation of optional selection switch 24. The selection switch 24 may be used by the user to select between two or more blower speeds, heater element temperature settings or combinations of both. The individual settings will be designated by indicia adjacent to the switch. In FIG. 1 a very simple configuration is shown in which there are three selections indicated by the dots 26. The user rotates the switch between the various dot settings by gripping an outwardly extending member 28 and turning the switch to the desired setting. The dots 26 may indicate, for instance, three different blower speeds, use of the blower with or without the heating element turned on, different temperature settings of the heating element and so forth. It will be noted that the selector switch 24 normally will not include means for turning the unit on or off, since that is performed automatically by the cooperation of the nozzle 18 and the off/on switch (described below) incorporated within the housing recess 38.

The flexible conduit 16 is a conventional hair dryer hose. The particular length chosen will be determined largely by the location in which the hair dryer is installed, to enable the user to stand within a reasonable distance of the hair dryer while using it and simultaneously use the bathroom mirror.

The outward end of the hose 16 is connected to nozzle 18, which in the configuraiton shown is a hollow tube with a right angle bend 31. The particular configuration makes it easy for the user to grip the nozzle at inward portion 30 and direct the air flow through outlet grill 32 against his or her hair. Outlet grill 32, which is fitted into the terminal end 34 of nozzle 18, is made of a magnetic metal to allow it to engage magnets 36 which protrude into recess 38 to releasably secure nozzle 18 when the unit is not in use.

Figure 3:
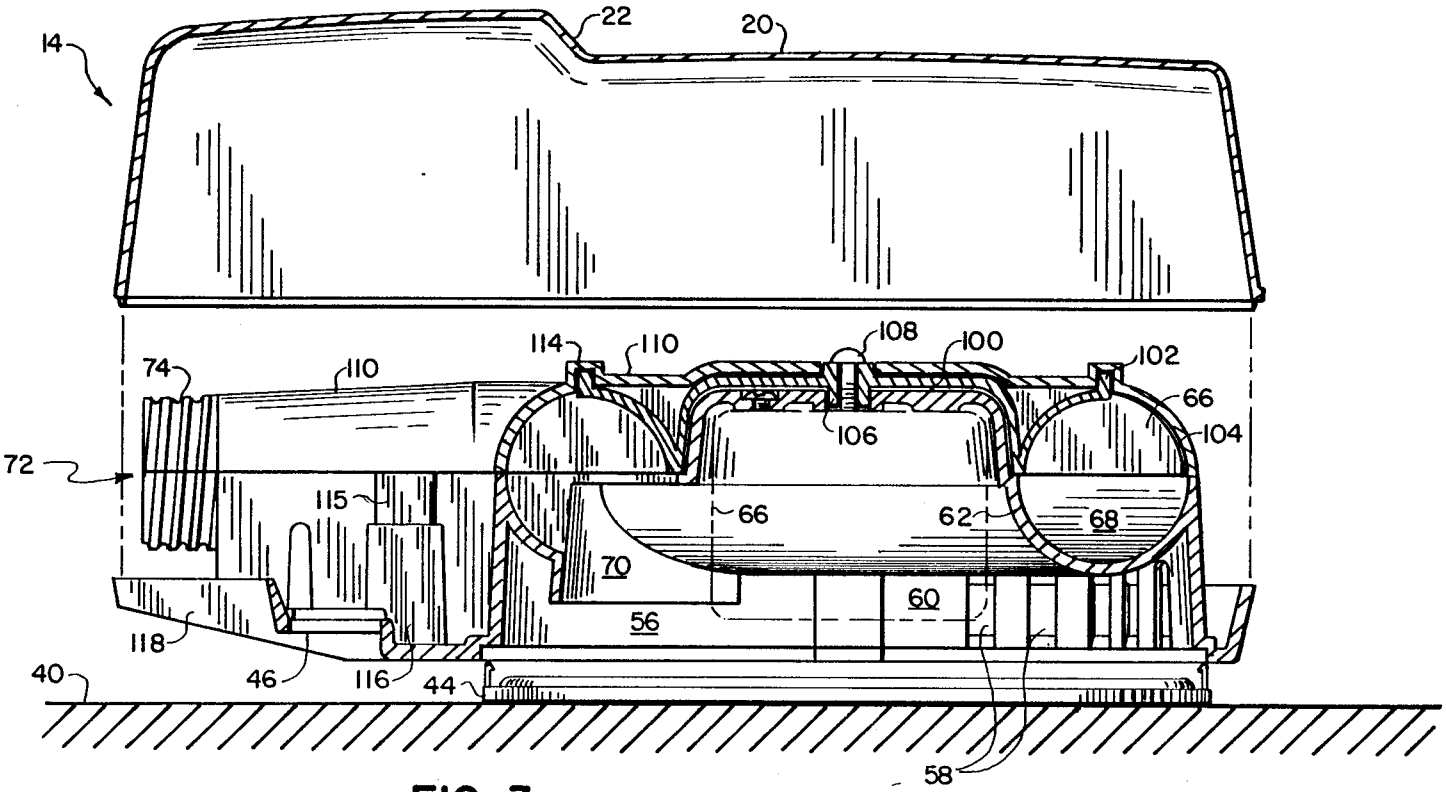
FIG. 3 is a secitonal view on line 3—3 of FIG. 2.

In use the unit is mounted on a flat surface which is illustrated in FIG. 3 as vertical wall 40. Typically this would be a wall in a hotel bathroom. The unit may be fastened to wall 40 by securing screws (not shown) through holes 42 into the wall. The configuration of the unit provides for base 44 to abut wall 40 and provides a standoff configuration that allows air intake grill 46 to be spaced apart from the wall 40 to provide for unimpeded airflow into the unit.

In operation the air flow (indicated by the stylized arrows 48) starts where the ambient air is drawn in through grill 46. As noted, the grill 46 is spaced apart from wall 40 to provide for a clear airflow path. It is critical to this invention that the airflow grill 46 be placed to the rear of the unit 12 adjacent the wall 40 and at the lower end of the unit when the unit is disposed in its normal vertical wall configuration shown in FIG. 1. It has been found that locating the grill in this manner minimizes the tendency of the unit to draw excess moisture through the unit and impede its performance. Presence of excess moisture is detrimental because it reduces the ability of the air to perform its drying function for the user's hair and in addition lowers the temperature to which the heating coil 50 can heat the air passing through the unit. Placement of the grill 46 in the lower rear position therefore provides a significant improvement in hair dryer peformance over prior art dryers which had front, top or side mounted grills.

The air is moved through the unit by the action of turbine 52 which will be described in detail below. The turbine 52 creates an area of reduced pressure at the inlet grille 46 which draws the ambient air into the housing at area 54. The air is then diverted by air chamber wall 56 and flows in a counterclockwise path around the side of wall 56 to a plurality of inlet slots 58 penetrating through wall 56 into air chamber 60, which is located directly below turbine 52 but separated therefrom by barrier 62 except at opening 64. Centrally positioned within air chamber 60 is electric motor 66 which drives turbine 52. (Motor 66 is shown in outline only in FIG. 3 to simplify the drawings and avoid obscuring other details. It will be recognized, of course, that the motor 66 is an integral part of the hair dryer of this invention.) The motor 66 is a conventional small alternating current electric motor. Use of an A-C motor represents a significant improvement in efficiency over the direct current motors used in most prior art hair dryers.

An important feature of this invention is the placement of motor 66 in the flow path of the incoming cool air, thus enabling the air circulating around the motor 66 to keep it cool during operation. It has been found that cooling of the motor substantitally reduces its operating noise level and also prolongs motor life.

The turning of turbine 52 creates low pressure at the exit opening 64 of air chamber 60 and the air is drawn up into the turbine blades 66 and moved counterclockwise through the air flow path 68. It will be noted from FIG. 3 that the turbine blades occupy the upper half of toroidal flow path 68. The air is caused to flow through flow path 68 either by direct impulse of the blades 66 in the upper half of flow path 68 or by the overall bulk air movement imparted to the air by the turbine blades for the lower half of air flow path 68.

The flow path 68 occupies most but not all of the path followed by the turbine blades 66. After the air has moved from outlet 64 around most of the toroidal flow path 68 it encounters barrier 70 which blocks the lower half of the flow path while letting the turbine blades pass directly above barrier 70. Most of the air flow is therefore diverted out of flow path 68 and through the heating chamber 72 which is a tubular conduit lined on the inside of the tube with heating coils 50. The heating coils 50 are electric resistance coils which are capable of heating the rapidly moving air to a temperature which is high enough to efficiently dry the user's hair but not so high as to cause discomfort or injury to the user. Typically the drying temperature will be on the order of 90° F. (32° C.). As discussed above with respect to switch 24, the heating coil may be wired in the circuitry such that it can be turned off separately while the air flow continues so that cooler air can be blown through the unit. Alternatively, one could have two interspersed heating coils, perhaps of different powers, so that the user, by use of selection switch 24 could choose a low power (low temperature) coil, a second coil which would provide an intermediate heat level or placing both coils in the circuit to provide a high heat option.

Figure 2:
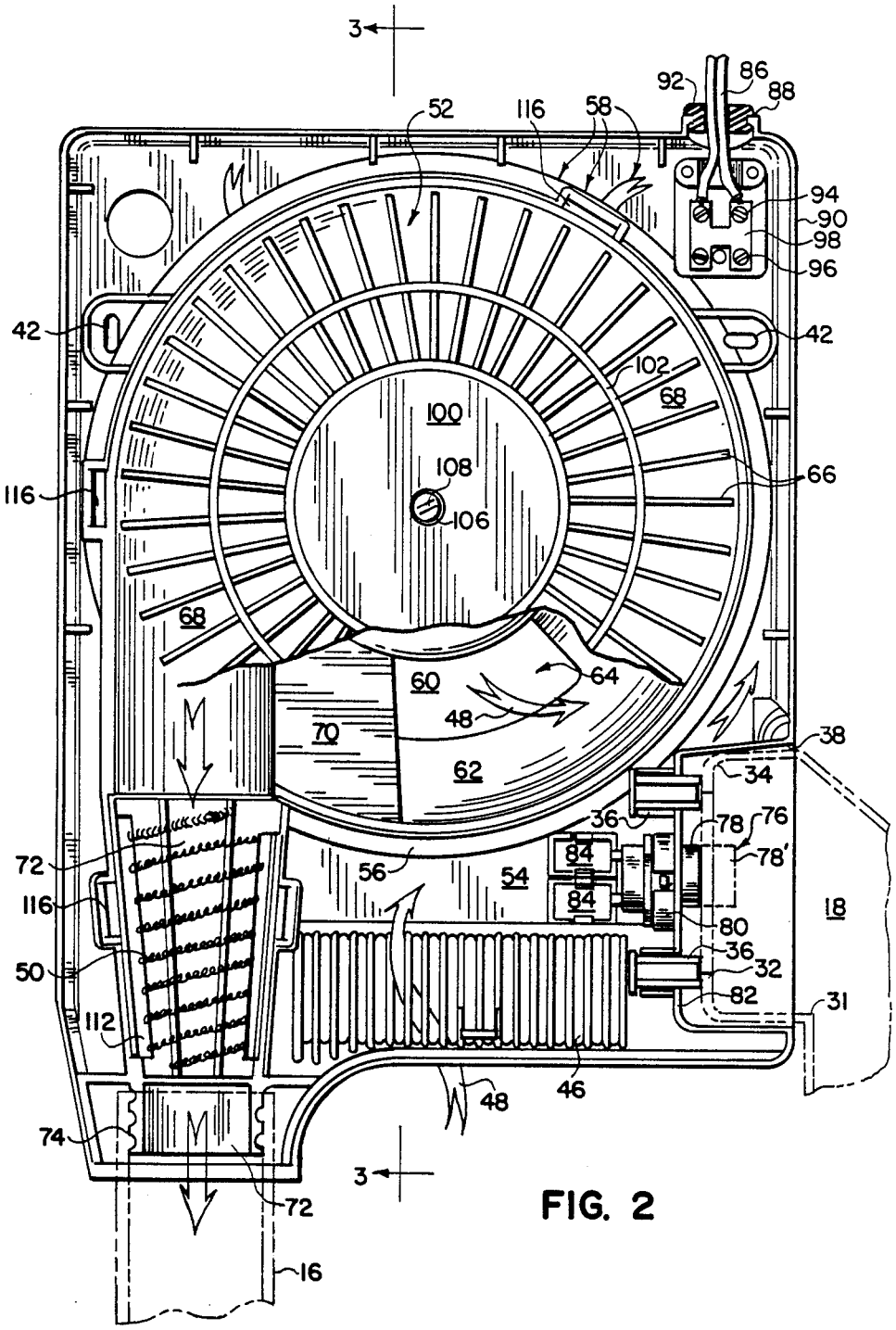
FIG. 2 is a plan view, partially cut away, of the main blower portion of the hair dryer, the inner and outer covers of the unit having been removed to reveal the internal structural features.

The heated air flows out of the main unit through outlet 72. It will be noted from FIGS. 2 and 3 that the outlet 72 has on the outside thereof screw threads 74. The inner end of hose 16 has corresponding internal screw threads to allow the hose to be easily and securely attached the outlet 72. The air then, of course, flows through conduit 16 and exit nozzle 18 to be directed by the user against his or her hair.

The unit is electrically driven and activated by removing nozzle 18 from recess 38 in which it had contacted switch 76. Switch 76 is a normally closed spring loaded switch and has as its elements plunger 78 which is slidably fitted in sleeve 80 penetrating through the wall 82 which forms recess 38, and microswitches 84 which are contacted by the base of plunger 80. the microswitches 84 are normally closed switches. Inserting nozzle 18 into recess 38 depresses plunger 78 and changes the microswitches to an open condition. When the nozzle 18 is removed from recess 38 the spring biasing of plunger 78 within sleeve 80 or through microswitches 84 causes the plunger to be biased outward and the microswitches 84 to return to their normally closed position. (The outwardly biased position of plunger 78 is shown in phantom at 78'.)

For simplicity in the drawings only a portion of the electrical wiring is shown. It will be evident from the following explanation, however, that the wiring is quite simple and conventional. Electrical wire 86 enters from an outside power source (not shown) through opening 88 in the casing 90 of the unit. The wire 86 is prevented from chafing in opening 88 by being passed through grommet 92 which is fitted in opening 88. The terminal ends of wire 86 are secured to screws 94 which are electrically connected respectively to screws 96 at the other end of terminal block 98. From screws 96 wires run in a simple series circuit to motor 60, heating coil 70 and microswitches 84 such that operation of the microswitches 84 controls the power to the motor 60 and the heating coil 70. Alternatively, one could have two series circuits, one including motor 60 and one of the microswitches 84, and the other including the heating coil 70 and the other microswitch 84. If a selection switch 24 is used, it will be incorporated into the series circuits in a conventional manner. The particular wiring will be depended upon the individual features to be selected by the switch as described above.

The heart of the present unit is turbine 52 which is the impeller for the air flow through the unit 12. The turbine consists of a plurality of C-shaped semi-circular or semi-elliptical turbine blades 66 which are radially spaced about a hub 100. The blades typically have lengths of about 1.5 inches (4 cm) and heights of 0.75 inches (2 cm). Annular rib 102 provides stiffening for the blades and maintains the proper spacing. Each of the blades 66 rotates with a small amount of clearance in the upper half 104 of flow path 68. The entire unit is mounted on hollow bearing 106 and is connected through bearing 106 to motor 60 by shaft screw 108. The turning of motor 66 therefore causes the rotation of the annular turbine unit 52. The turbine blades 66 are formed in a semi-circular shape so that the blades will clear barrier 70 as they rotate. Typical rotational speed of the turbine is on the order of 2900 to 5000 revolutions per minute.

Turbine 52 represents a much more efficient way of moving air through the unit than has been accomplished by prior art hair dryers. While turbines have in the past been used in other types of equipment such as large air conditioners, Applicant believes that such turbine have never before been designed for use in the hair dryers of the present type. Prior art hair dryers have utilized simple fan blades or squirrel cage blower assemblies, neither of which provides the degree of efficiency of creating air movement which is characteristic of the present turbine. In part, this is believed to be due to the turbine blade shape and air moving properties and partly it is believed to be due to the ability of the turbine to create areas of significantly reduced pressure such as at opening 64 which is the outlet of air chamber 60. Such reduced air pressure improves air flow through the unit and provides a much more efficient ratio of power expended versus air flow.

The top of the unit is composed of two separate covers, an internal cover 110 over the turbine and air flow path and an external housing 20 for the entire unit. The internal cover 110 is molded to fit over the top of turbine 52 and air chamber 60 and abut wall 56 and heater chamber wall 112. An annular recess 114 is provided as a guide track for rib 102. The cover 110 is releasably attached to the lower part of the unit by spring tabs 115 on the outside thereof which engage slots 116 molded in wall 56 and wall 112. The outer housing 20 fits over the entire unit as shown in FIG. 3 and is releasably secured in any conventional manner, as by screws, claws at one end and a screw at the other or spring tabs and slots of the type used with cover 110. Most preferred is a screw-and-claw arrangement in which there are one or more claws at the upper end of the unit which are engaged by tilting the casing 20 and a single screw at the lower end of housing 20 engaging a corresponding socket molded into the lower portion 118 of the housing. For final appearance the screw may be mounted in a small recess on casing 20 and that recess may be removably covered with a decorative label, logo, applique or the like. To outward appearances therefore the unit appears to be completely sealed and tampering by users is discouraged.

It will be evident from the foregoing that there are numerous embodiments of this invention which, while not specifically described, are clearly within the scope and spirit of the invention. The above discussion is therefore intended to be exemplary only and the scope of the invention is to be determined solely by the appended claims.

I claim:

1. In a surface mounted hair dryer having:

i. a housing having one side adapted to mount on said surface and having an air inlet and an air outlet thereto, said inlet and outlet being the opposite ends of an air flow path defined through said housing;

ii. an air impeller in said flow path to cause air to flow along said path from said inlet to said outlet;

iii. heat generating means in said flow path between said impeller and said air outlet to warm said air;

iv. a flexible conduit connecting said air outlet of said housing to a remote air exit nozzle and through which the warmed air passes to be directed toward the user's hair; and v. means to activate said impeller;

the improvement comprising:

a. said air inlet being located in said housing adjacent said side which is adapted to mount on said surface, and being disposed proximate the lower end of said housing when said housing is mounted on said surface in a vertical orientation;

b. an air chamber within said housing and in said flow path between said housing air inlet and said impeller, said chamber itself having an air inlet and an air outlet;

c. said impeller comprising a rotary air turbine having a plurality of radially extending blades, said turbine blades being disposed closely adjacent to said air chamber air outlet and, upon activation of said turbine, creating a zone of reduced air pressure at said air chamber air outlet, and drawing air through said air chamber and forcing it under pressure toward said housing air outlet, conduit and exit nozzle; and d. said activating means comprising an electric motor having a shaft on which said turbine is rotationally mounted, a source of electric current to said motor, and switch means to turn said current on or off, with said motor disposed within said air chamber in the flow path of air being drawn toward said turbine to maintain a cool operating temperature for said motor.

2. In the hair dryer of claim 1, the improvement further comprising a casing surrounding said turbine and defining a toroidal air flow path from said air chamber outlet toward said housing air outlet, said turbine blades rotating within said toroidal path.

3. In the hair dryer of claim 1, the improvement further comprising said electric motor being an alternating current motor.

4. In the hair dryer of claim 1, the improvement further comprising having stowage means on said housing to stow said exit nozzle when not in use, said switch being a normally closed switch and disposed in said stowage means, said exit nozzle when seated in said stowage means being in contact with said switch and maintaining said switch in its open position.

5. In the hair dryer of claim 4, the improvement further comprising having said switch generally centrally disposed within said stowage means and said exit nozzle contacting said switch at the central portion of said nozzle.

6. In the hair dryer of claim 1, the improvement further comprising said housing air outlet having a generally cylindrical shape and said flexible conduit being attached thereto by a screw fit.

7. In the hair dryer of claim 1, the improvement further comprising said turbine having a rotational speed in the range of from 2900 to 5000 revolutions per minute.

* * * * *